US011395941B2

(12) United States Patent
Kikuchi

(10) Patent No.: US 11,395,941 B2
(45) Date of Patent: Jul. 26, 2022

(54) BALANCE TRAINING SYSTEM AND CONTROL METHOD FOR BALANCE TRAINING SYSTEM

(71) Applicant: Toyota Jidosha Kabushiki Kaisha, Toyota (JP)

(72) Inventor: Mitsugu Kikuchi, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 348 days.

(21) Appl. No.: 16/810,185

(22) Filed: Mar. 5, 2020

(65) Prior Publication Data

US 2020/0289896 A1 Sep. 17, 2020

(30) Foreign Application Priority Data

Mar. 15, 2019 (JP) ..... JP2019-047887

(51) Int. Cl.
*A63B 24/00* (2006.01)
*A63B 26/00* (2006.01)
*A63B 22/00* (2006.01)

(52) U.S. Cl.
CPC ..... *A63B 26/003* (2013.01); *A63B 24/0062* (2013.01); *A63B 2022/0094* (2013.01); *A63B 2208/0204* (2013.01); *A63B 2230/01* (2013.01)

(58) Field of Classification Search
CPC ..... A63B 26/003; A63B 24/0062; A63B 2022/0094; A63B 2208/0204; A63B 2230/01; A63B 22/20; A63B 2024/0093; A63B 71/0009; A63B 71/0054; A63B 24/0087; A63B 71/0622; A63B 71/0669; A63B 2024/0096; A63B 2071/025; A63B 2071/0638; A63B 2071/0647; A63B 2071/0675; A63B 2071/0683; A63B 2220/20; A63B 2220/30; A63B 2220/52; A63B 2220/54; A63B 2220/80; A63B 2220/833
See application file for complete search history.

(56) References Cited

U.S. PATENT DOCUMENTS 9,149,222 B1 * 10/2015 Zets ..... A61B 5/4023
9,526,946 B1 * 12/2016 Zets ..... A61B 5/4023
10,117,602 B1 * 11/2018 Berme ..... A61B 5/1128
(Continued)

FOREIGN PATENT DOCUMENTS

JP 2015-100477 A 6/2015
JP 2016-141326 A 8/2016

*Primary Examiner* — Sundhara M Ganesan
(74) *Attorney, Agent, or Firm* — Dinsmore & Shohl LLP

(57) ABSTRACT

A balance training system includes a moving carriage that moves on a moving surface, and a detection unit that detects a load received from training person's feet, and drives a driving unit based on the load's center of gravity of the feet to control movement of the moving carriage. A boarding plate is divided into a front plate on which a toe side of the feet is placed and a rear plate on which a heel side of the feet is placed. The detection unit includes right and left front load sensors, respectively provided with tilts to right and left foot sides, on a rear surface side opposite to the boarding surface of the front plate, and right and left rear load sensors, respectively provided with tilts to the right and left foot sides, on a rear surface side opposite to the boarding surface of the rear plate.

7 Claims, 10 Drawing Sheets

(56) References Cited

U.S. PATENT DOCUMENTS

| | | | | |
|---|---|---|---|---|
| 2009/0240172 | A1* | 9/2009 | Fernandez Tournier | A63B 26/003 600/595 |
| 2011/0312473 | A1* | 12/2011 | Chu | A63B 22/0292 482/54 |
| 2012/0094814 | A1* | 4/2012 | Atkins | A61B 5/1036 482/142 |
| 2015/0328497 | A1* | 11/2015 | Doucot | A63B 24/0062 482/146 |
| 2015/0343266 | A1* | 12/2015 | Vardy | A63B 26/003 482/8 |
| 2016/0228746 | A1* | 8/2016 | Jayakumar | A63B 71/0054 |
| 2016/0346156 | A1* | 12/2016 | Walsh | A61H 3/008 |
| 2017/0189259 | A1* | 7/2017 | Song | A61F 4/00 |
| 2018/0289579 | A1* | 10/2018 | Agrawal | A61B 5/112 |

* cited by examiner

BALANCE TRAINING SYSTEM AND CONTROL METHOD FOR BALANCE TRAINING SYSTEM

CROSS REFERENCE TO RELATED APPLICATIONS

This application is based upon and claims the benefit of priority from Japanese patent application No. 2019-047887, filed on Mar. 15, 2019, the disclosure of which is incorporated herein in its entirety by reference.

BACKGROUND

The present disclosure relates to a balance training system and a control method for balance training system.

A training apparatus for a patient with a disability in his/her leg to perform rehabilitation training is becoming widespread. For example, a training apparatus that moves a footboard with driving means in order to make a training person who performs training stand on the footboard and observe a center of gravity position, and to encourage the training person to take a step or prevent the training person from falling is known (for example, see Japanese Unexamined Patent Application Publication No. 2015-100477).

SUMMARY

In a configuration in which a footboard moves by a small amount relative to the training apparatus, the training person basically maintains a state in which he/she stands upright with respect to a floor surface, which makes it difficult to maintain the training person's motivation due to poor changes in environment during training. When game characteristics are given to a training attempt, the greater the bodily sensation achieved in association with a game, the greater the training person is motivated to take part in the training attempt. It has been found that a configuration in which a moving carriage is provided in a balance training apparatus and the entire balance training apparatus moves while a training person is on board is effective for rehabilitation training.

However, it may sometimes be difficult for the training person to maintain a state in which the training person is standing on a boarding surface, because a movement amount of the moving carriage in such a balance training apparatus can be set as appropriate, for example, in association with the game. In particular, when the moving carriage is controlled according to how much the load's center of gravity of the training person's feet is displaced from a reference position, for example, if one foot is lifted from the boarding surface, there may be a sudden variation in the movement of the moving carriage that the training person docs not expect. It has thus become necessary to calculate a load's center of gravity accurately in order to perform safety control that prevents sudden movement variations.

The present disclosure has been made to solve such a problem. An object of the present disclosure is to provide a balance training system and the like that allow a training person having a disease in his/her balance function to perform rehabilitation training safely and effectively.

A first example aspect is a balance training system including: a moving carriage configured to be able to move on a moving surface by driving a driving unit; a detection unit configured to detect a load received from training person's feet standing on the moving carriage; a calculation unit configured to calculate a load's center of gravity of the training person's feet on a boarding surface from the load detected by the detection unit; and a control unit configured to drive the driving unit based on the load's center of gravity calculated by the calculation unit to control movement of the moving carriage. A boarding plate constituting the boarding surface is divided into a front plate and a rear plate, a toe side of the training person's feet is placed on the front plate, and a heel side of the training person's feet is placed on the rear plate, and the detection unit comprises a right front load sensor provided with a tilt to a right foot side and a loft front load sensor provided with a tilt to a left foot side on a rear surface side opposite to the boarding surface of the front plate and a right rear load sensor provided with a tilt to the right fool side and a left rear load sensor provided with a tilt to the left foot side on a rear surface side opposite to the boarding surface of the rear plate. In this way, when the front plate and the rear plate each including a load sensor are independent from each other, it is possible to accurately detect lifting of the toe and heel, thereby enabling an accurate calculation of a load's center of gravity.

In the above balance training system, the front plate may be divided into a right front plate corresponding to a position where the right front load sensor is provided and a left front plate corresponding to a position where the left front load sensor is provided, and the rear plate may be divided into a right rear plate corresponding to a position where the right rear load sensor is provided and a left rear plate corresponding to a position where the left rear load sensor is provided. When the boarding plate is divided into the left and right boarding plates in addition to being divided into the front and rear boarding plates in this way, it is possible to more accurately distinguish between the lifting of the right foot and the lifting of the left foot. Further, when the boarding plate is divided in this way, the training person scan board in a direction orthogonal to the moving direction of the moving carriage. Thus, the single balance training system can also be used safely for balance training in the right-left direction.

Further, the control unit of the above balance training system may be configured to determine whether the training person's toe and heel is lifted in the air based on the load's center of gravity calculated by the calculation unit, and control the movement of the moving carriage based on a result of the determination. For example, when the control unit determines that one of the training person's toes and the training person's heels are lifted in the air, the control unit is configured to perform deceleration control for gradually decreasing a moving speed of the moving carriage. Alternatively, when the control unit determines that one of the training person's toes and the training person's heels are lifted in the air, the control unit may be configured to perform limit speed control for limiting a moving speed of the moving carriage to less than or equal to a predetermined limit speed. It is desirable to perform safe movement control in this way when the training person's toe or heels are lifted in the air, in consideration of the possibility of the training person losing his/her balance.

A second example aspect is a control method for a balance training system comprising a moving carriage configured to be able to move on a moving surface by driving a driving unit, the control method comprising: detecting a load received from training person's feet standing on the moving carriage; calculating a load's center of gravity of the training person's feet on a boarding surface from the load detected by the detecting; and controlling the driving unit based on the load's center of gravity calculated by the calculating to control movement of the moving carriage, wherein a boarding plate constituting the boarding surface is divided into a front plate and a rear plate, a toe side of the training person's feet is being placed on the front plate, and a heel side of the training person's feet is being placed on the rear plate, and the detecting is executed by a right front load sensor provided with a tilt to a right foot side and a left front load sensor provided with a tilt to a left foot side on a rear surface side opposite to the boarding surface of the front plate and a right rear load sensor provided with a tilt to the right foot side and a left rear load sensor provided with a tilt to the left foot side on a rear surface side opposite to the boarding surface of the rear plate.

According to the present disclosure, it is possible to provide a balance training system and the like that allow a training person having a disease in his/her balance function to perform rehabilitation training safely and effectively.

The above and other objects, features and advantages of the present disclosure will become more fully understood from the detailed description given hereinbelow and the accompanying drawings which are given by way of illustration only, and thus are not to be considered as limiting the present disclosure.

DETAILED DESCRIPTION

Hereinafter, the present disclosure will be described through embodiments of the disclosure, but the disclosure according to the claims is not limited to the following embodiments. Further, all of the configurations described in the embodiments are not necessarily essential as means for solving the problem.

Figure 1:
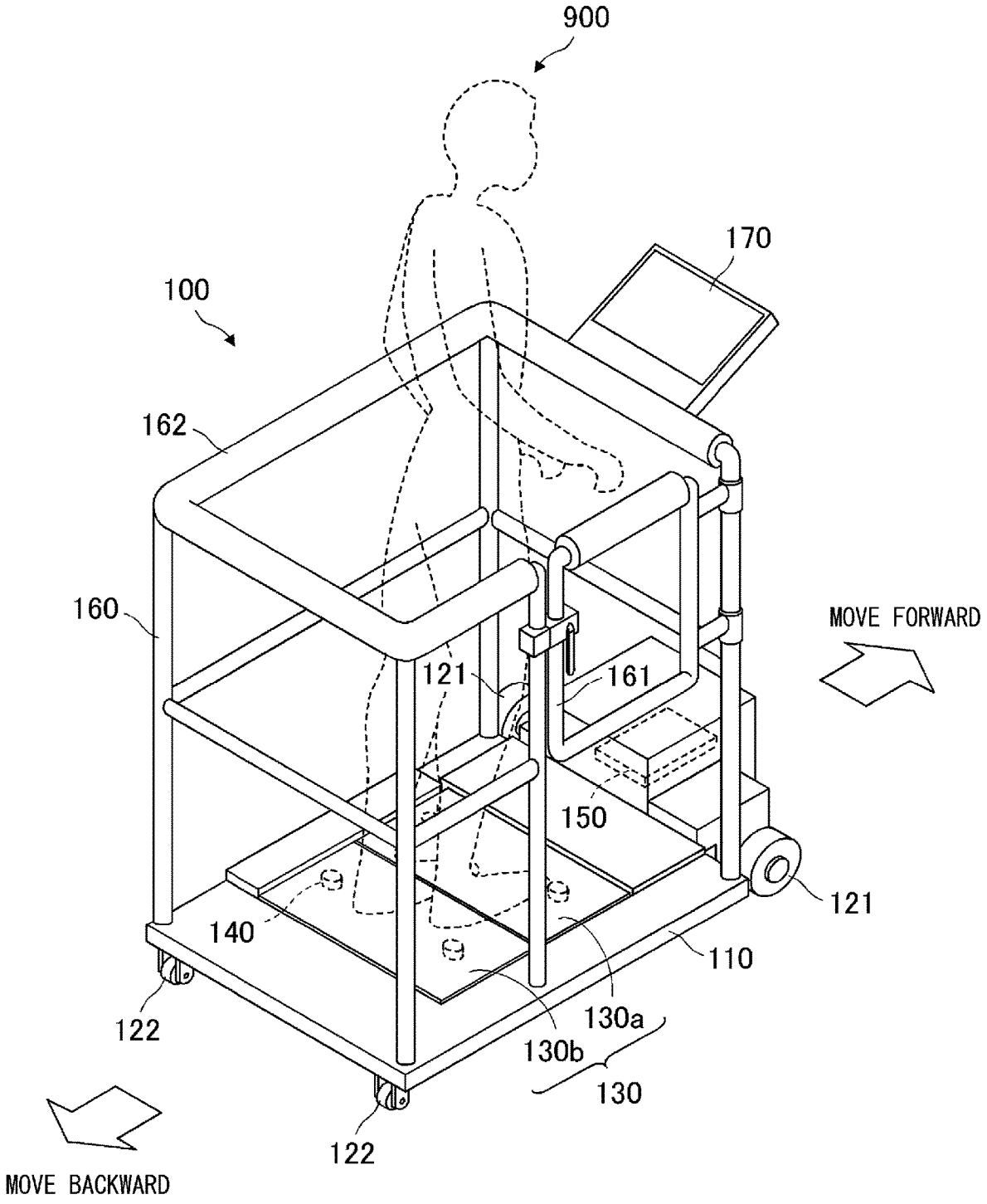
FIG. 1 is a schematic perspective view of a balance training apparatus according to an embodiment.

FIG. 1 is a schematic perspective view of a training apparatus 100 as an example of a balance training apparatus according to this embodiment. The training apparatus 100 is an apparatus for a disabled person with a disability such as hemiplegia to learn to shift his/her center of gravity which is necessary for walking, or for a patient with a disability in his/her ankle joint to recover the ankle joint function. For example, when a training person 900 who wants to recover the ankle joint function tries to continue boarding the training apparatus 100 while maintaining his/her balance, the training apparatus 100 can apply a load that can expect a rehabilitation effect to the training person 900's ankle joint.

The training apparatus 100 includes a moving carriage 110 and a frame 160. The moving carriage 110 is able to move in a front-rear direction on a moving surface that is a floor surface or the like of a rehabilitation facility. The frame 160 is provided to stand on the moving carriage 110 and prevents the training person 900 boarding the moving carriage 110 from falling. The moving carriage 110 mainly includes driving wheels 121, casters 122, a boarding plate 130, load sensors 140, and a control box 150.

The driving wheels 121 are arranged as two front wheels with respect to a traveling direction. Each driving wheel 121 is rotationally driven by a motor (not shown) as a driving unit, and moves the moving carriage 110 forward or backward. The casters 122 are driven wheels and are arranged as two rear wheels with respect to the traveling direction. The boarding plate 130 is a boarding unit on which the training person 900 boards and places his/her feet. Specifically, the boarding plate 130 is divided into a front plate 130*a* on which a toe side of the training person 900's feet is placed and a rear plate 130*b* on which a heel side of the training person 900's feet is placed. A flat plate made of, for example, a polycarbonate resin with a relatively high rigidity that can withstand the boarding of the training person 900 is used as each of the front plate 130*a* and the rear plate 130*b*. Each of the front plate 130*a* and the rear plate 130*b* is supported on an upper surface of the moving carriage 110 with the load sensors 140 interposed therebetween.

Each of the load sensors 140 is, for example, a load cell, and functions as a detection unit that detects a load received from the training person 900's feet standing on the moving carriage 110. A specific arrangement of the load sensors 140 will be described later. The control box 150 accommodates an arithmetic processing unit and a memory, which will be described later.

The frame 160 includes an opening and closing door 161 and a handrail 162. The opening and closing door 161 is opened when the training person 900 boards the boarding plate 130 to form a passage for the training person 900. The opening and closing door 161 is closed and locked when the training person 900 performs a training attempt. The handrail 162 is provided to surround the training person 900 so that it can be grasped when the training person 900 is about to lose his/her balance or feels uneasy. Note that when the training person 900 performs a training attempt, he/she tries to maintain an upright posture by maintaining his/her balance by himself/herself without grasping the handrail 162. The frame 160 supports a display panel 170. The display panel 170 is a display unit that is, for example, a liquid crystal panel. The display panel 170 is disposed at a position where the training person 900 can easily see during the training attempt.

Figure 2:
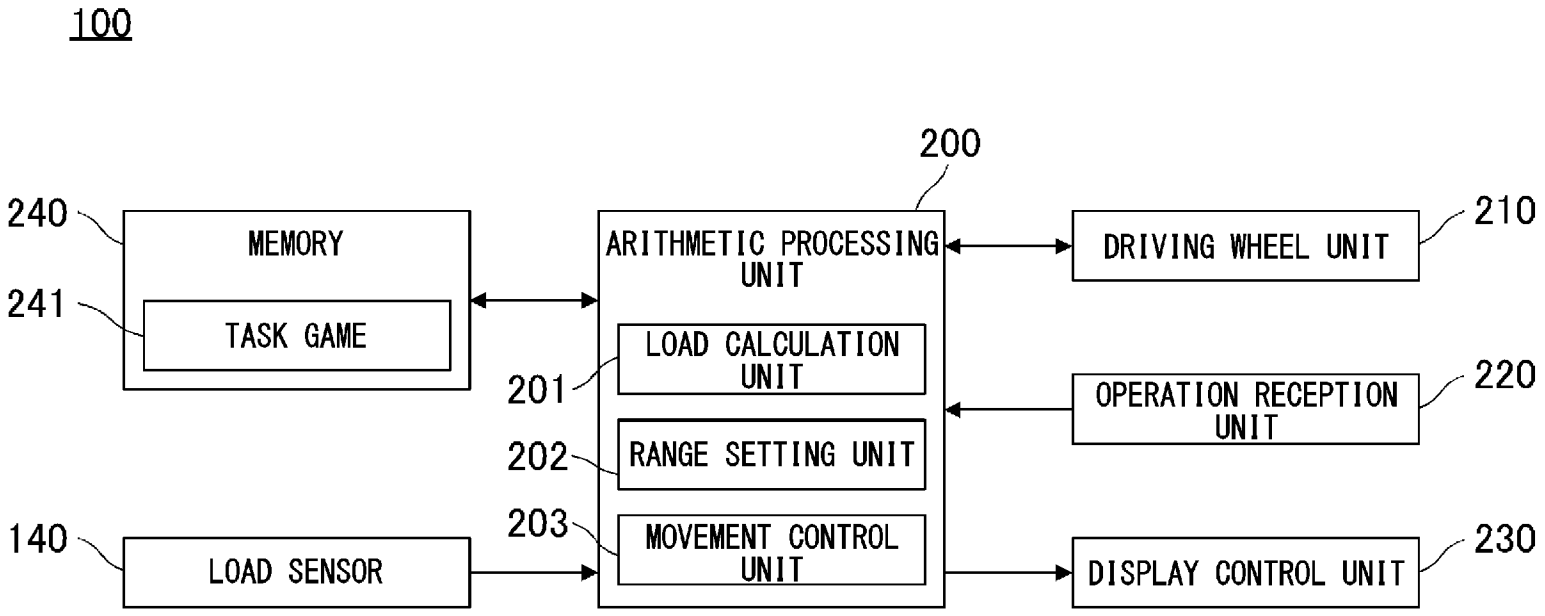
FIG. 2 shows a system configuration of the balance training apparatus.

FIG. 2 shows a system configuration of the training apparatus 100. An arithmetic processing unit 200 is, for example, an MPU and performs control of the entire apparatus by executing a control program read from a memory 240. A driving wheel unit 210 includes a driving circuit and a motor for driving the driving wheels 121. The driving wheel unit 210 includes a rotary encoder that detects an amount of rotation of the driving wheels 121.

An operation reception unit 220 receives input operations from the training person 900 and an operator, and transmits an operation signal to the arithmetic processing unit 200. The training person 900 or the operator operates an operation button provided on the apparatus, a touch panel superimposed on the display panel 170, an attached remote controller, or the like, which constitute the operation reception unit 220, in order to give an instruction for turning on and off the power and for starting a training attempt, to enter numerical values for setting, and to select menu items.

A display control unit 230 generates a graphic video image and the like of a task game, which will be described later, in accordance with a display signal from the arithmetic processing unit 200, and displays the graphic video image and the like on the display panel 170. The memory 240 is a non-volatile storage medium. For example, a solid state drive is used as the memory 240. The memory 240 stores a control program and so on for controlling the training apparatus 100. The memory 240 further stores various parameter values, functions, lookup tables and so on used for control. In particular, the memory 240 stores a task game 241 that is a program for giving a task in a game format so that the training person 900 can enjoy a training attempt. Two load sensors 140 are provided for each of the front plate 130*a* and the rear plate 130*b*. The load sensors 140 detect loads applied from the training person 900's feet via the front plate 130*a* and the rear plate 130*b*, and transmit detection signals to the arithmetic processing unit 200.

The arithmetic processing unit 200 also serves as a function execution unit that performs various calculations and control of individual elements in accordance with a request of the control program. A load calculation unit 201 acquires the detection signals of the four load sensors 140 and calculates a load's center of gravity of the training person 900's feet on the boarding surface. A specific calculation method will be described later.

A range setting unit 202 sets a stable range that is a range of the load's center of gravity estimated that the training person 900 can maintain upright on the boarding surface. A specific setting method will be described later. A movement control unit 203 generates a driving signal to be transmitted to the driving wheel unit 210, and controls the movement of the moving carriage 110 via the driving wheel unit 210. In this embodiment, in particular, safety control for ensuring safety is performed when it is determined that the load's center of gravity is outside the stable range during a training attempt in which the motor is driven and the moving carriage 110 is moved. Details of the safety control will be described later.

The arithmetic processing unit 200 may be composed of one or more processors. The load calculation unit 201, the range setting unit 202, and the movement control unit 203 may be composed of one or more processors. Alternatively, the load calculation unit 201, the range setting unit 202, the movement control unit 203, and the display control unit 230 may be composed of one or more processors.

Figure 3:
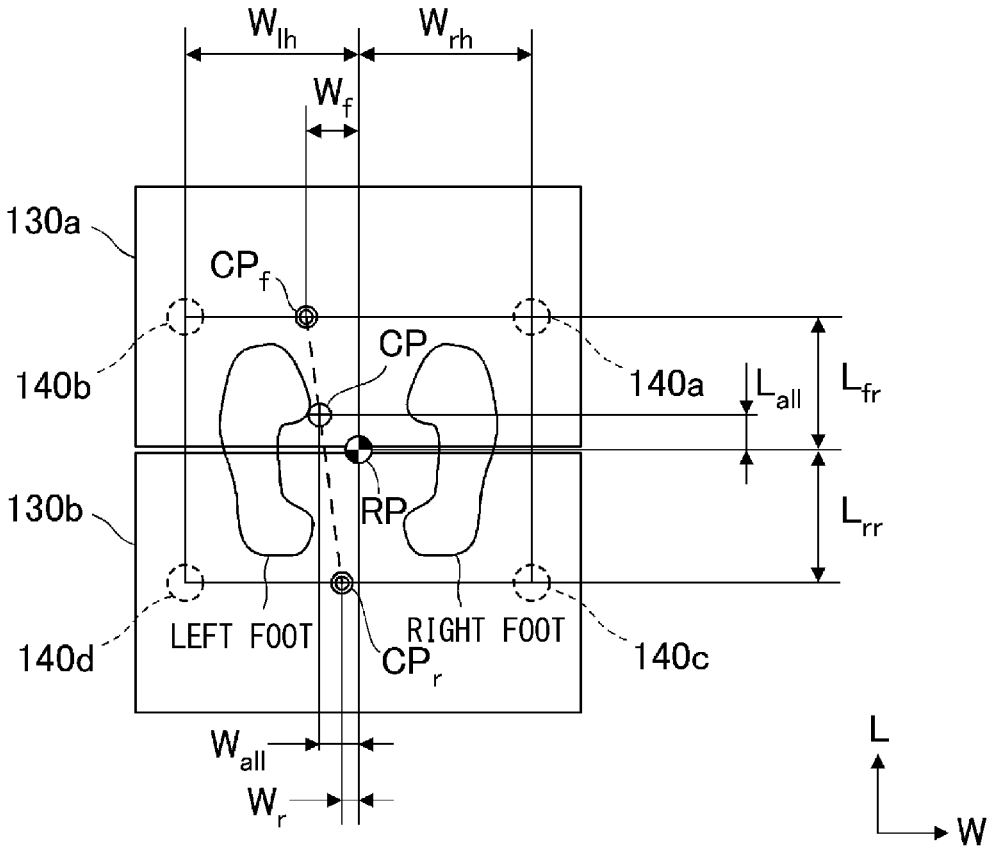
FIG. 3 is a diagram for explaining calculation of a load's center of gravity.

FIG. 3 is a diagram for explaining the calculation of the load's center of gravity. As shown in the drawing, the front plate 130*a* is supported by a right front load sensor 140*a* that is tilted to the right foot side and a left front load sensor 140*b* that is tilted to the left foot side on a rear surface side that is opposite to the boarding surface. Likewise, the rear plate 130*b* is supported by a right rear load sensor 140*c* that is tilted to the right foot side and a left rear load sensor 140*d* that is tilted to the left foot side on the rear surface side opposite to the boarding surface. A center position of the entire boarding plate 130 including the front plate 130*a* and the rear plate 130*b* is defined as a reference position RP.

The reference position RP is defined as an origin. As shown in the drawing, a direction orthogonal to a traveling direction is defined as a W axis, and the traveling direction is defined as an L axis. Further, the positions where the right front load sensor 140*a*, the left front load sensor 140*b*, the right rear load sensor 140*c*, and the left rear load sensor 140*d* are installed are defined as ($W_{rh}$, $L_{fr}$), ($W_{lh}$, $L_{fr}$), ($W_{rh}$, $L_{rr}$), and ($W_{lh}$, $L_{rr}$), respectively. A coordinate value $W_f$ of a load's center of gravity $CP_f$ on the toe side in the right-left direction is expressed by the Formula 1.

$$W_f=(f_a\times W_{rh}+f_b\times W_{lh})/(f_a+f_b) \quad \text{(Formula 1)}$$

In the Formula 1, $f_a$ is a load detected by the right front load sensor 140*a*, and $f_b$ is a load detected by the left front load sensor 140*b*.

Likewise, a coordinate value $W_r$ of a load's center of gravity $CP_r$ on the heel side in the right-left direction is expressed by the Formula 2.

$$W_r=(f_c\times W_{rh}+f_d\times W_{lh})/(f_c+f_d) \quad \text{(Formula 2)}$$

In the Formula 2, $f_c$ is a load detected by the right rear load sensor 140*c*, and $f_d$ is a load detected by the left rear load sensor 140*d*.

Then, a coordinate value of the entire load's center of gravity CP ($W_{all}$, $L_{all}$) is expressed by the Formulas 3 and 4.

$$W_{all}=((f_a+f_b)\times W_f+(f_c+f_d)\times W_r)/(f_a+f_b+f_c+f_d) \quad \text{(Formula 3)}$$

$$L_{all}=((f_a+f_b)\times L_{fr}+(f_c+f_d)\times L_{rr})/(f_a+f_b+f_c f_d) \quad \text{(Formula 4)}$$

When the load's center of gravity CP is calculated in this way, for example, when the toe of the right foot is lifted in the air, the load applied to the heel of the right foot is not transmitted to the right front load sensor 140*a*. Thus, the load's center of gravity $CP_f$ is largely tilted to the left side. Further, when the heel of the left foot is lifted in the air, the load applied to the toe of the left foot is not transmitted to the left rear load sensor 140*d*. Thus, the load's center of gravity $CP_r$ is largely tilted to the right side. It is thus possible to determine whether the toe and heel are lifted in the air by observing $CP_f$ and $CP_r$, because $CP_f$ and $CP_r$ are largely tilted when the toe and heel are lifted in the air. For example, a threshold is provided for each of the coordinate values in advance, and when a coordinate value exceeding the threshold and is tilted to one side is detected, it is determined that the lifting of the toe and heel is occurring. When both $f_a$ and $f_b$ are smaller than a predetermined threshold, it can be determined that both toes are lifted in the air. In this case, $CP=CP_r$. Likewise, when both $f_c$ and $f_d$ are smaller than a predetermined threshold, it can be determined that both heels are lifted in the air. In this case, $CP=CP_f$.

Figure 4:
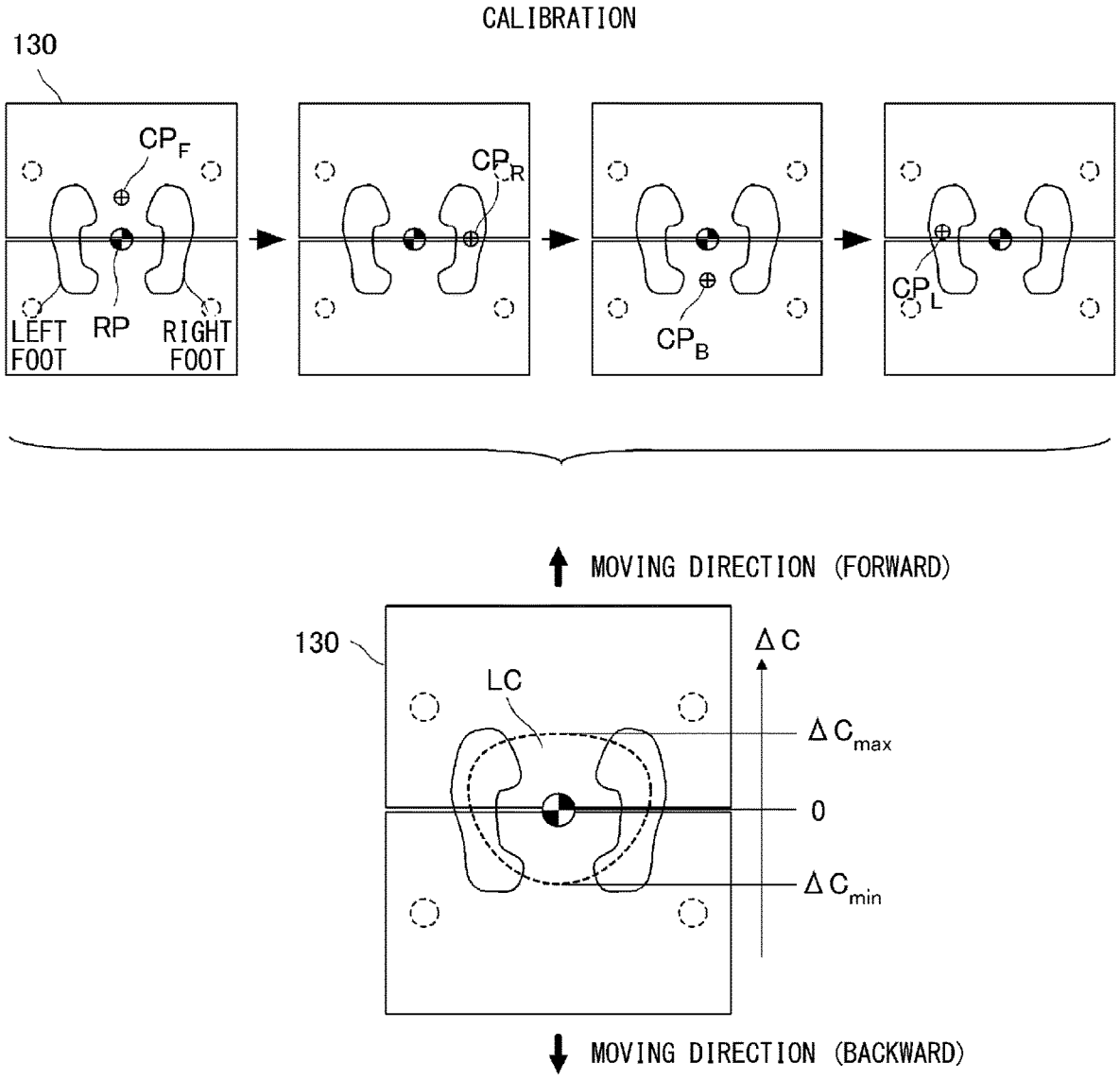
FIG. 4 is a diagram for explaining a setting of a stable range.

FIG. 4 is a diagram for explaining the setting of the stable range. The range setting unit 202 sets a stable range through a calibration work performed by the training person 900 prior to a training attempt. In the calibration work, the training person 900 stands on the boarding surface with a natural as possible standing posture so that the reference position RP determined with respect to the boarding surface is positioned at a midpoint between the feet. Then, in the order shown in the upper diagram of FIG. 4, while the training person 900 maintains the standing posture, the training person 900 shifts his/her center of gravity forward until right before the heels of the feet are lifted in the air, and then shifts his/her center of gravity on the right foot until right before the left foot is lifted in the air, and then shifts his/her center of gravity backward until right before the toes of the feet are lifted in the air, and lastly shifts his/her center of gravity on the left foot until right before the right foot is lifted in the air. As shown in the drawing, the load calculation unit 201 calculates each load's center of gravity $CP_F$, $CP_R$, $CP_B$, and $CP_L$ for each shift in the center of gravity.

The range setting unit 202 fits a smooth closed curve so as to pass through each load's center of gravity $CP_F$, $CP_R$, $CP_B$, and $CP_L$ calculated in this manner, and sets a range surrounded by the closed curve as a stable range LC. The stable range LC set in this way is a range in which the training person 900 is expected to be able to maintain a standing state by adjusting his/her balance while the load's center of gravity of the training person 900 is included in this range. In this embodiment, since the moving direction of the moving carriage 110 is the front-rear direction, a ΔC axis is defined along the moving direction within the two-dimensionally defined stable range LC. Along the ΔC axis, the reference position RP is defined as 0, a maximum value of the stable range LC is defined as $\Delta C_{max}$, and a minimum value of the stable range LC is defined as $\Delta C_{min}$. The stable range LC may be set by selecting, from a preset lookup table, a stable range corresponding to the training person 900's height, weight, foot size, a progress of rehabilitation training, etc., in addition to the stable range LC being set through a calibration work.

In this embodiment, the training person 900 is encouraged to perform training by carrying out the task game 241. The task game 241 processed by the arithmetic processing unit 200 generates a constantly changing graphic video image and displays the graphic video image on the display panel 170, and the training person 900 is encouraged to perform a moving operation of the training apparatus 100.

Figure 5A:
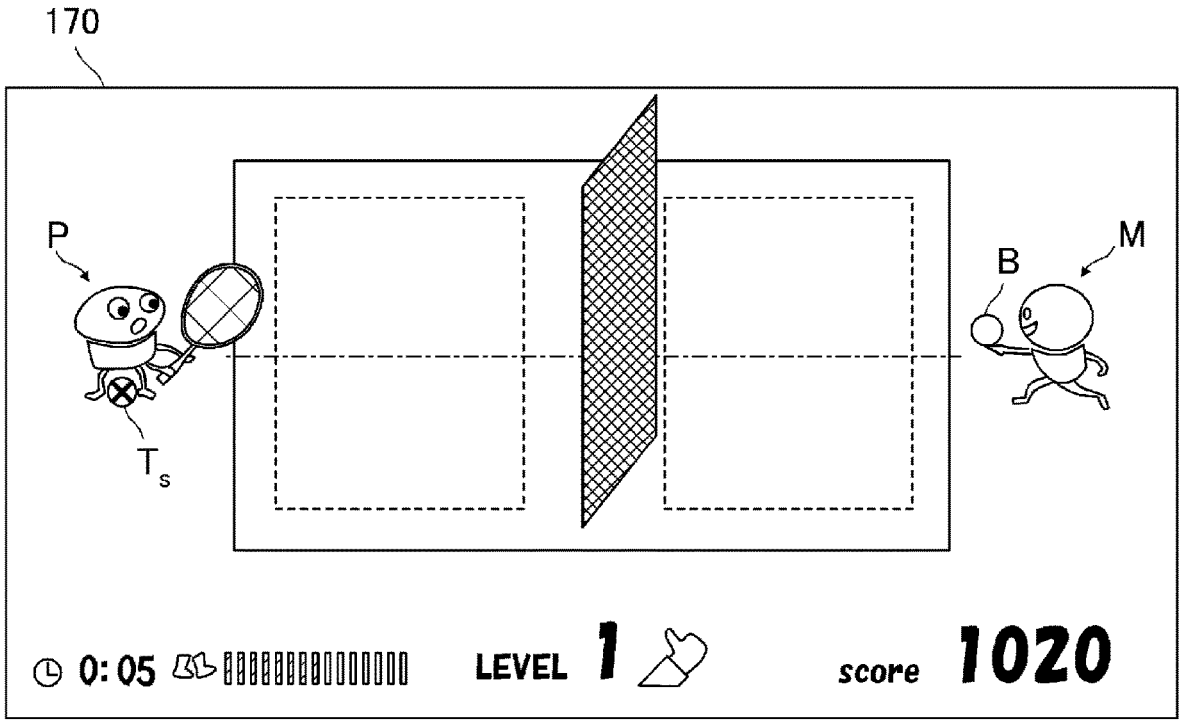
FIG. 5A shows a game screen at the time of starting a training attempt.
Figure 5B:
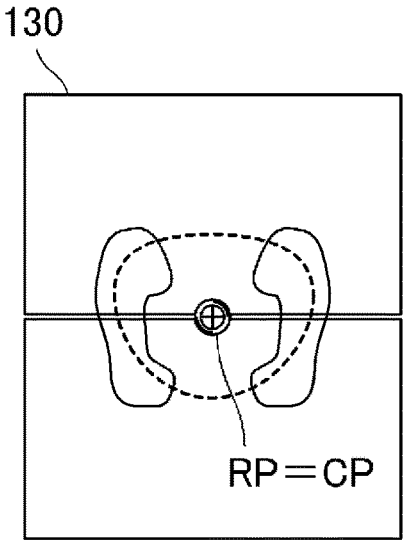
FIG. 5B shows a load's center of gravity of a training person.

FIG. 5A shows a game screen at the time of starting a training attempt, and FIG. 5B shows a load's center of gravity of the training person 900 at that time. The game screen is a video image displayed on the display panel 170, and shows that a game with a tennis concept is selected from among a plurality of task games 241 and then carried out.

On the right side of the tennis court displayed at the center of the screen, a character M throwing a tennis ball B is superimposed on a background image, and on the left side of the tennis court, a character P hitting the thrown tennis ball B back is superimposed on the background image. The character M expresses an action of moving up and down or throwing according to the task given by the task game 241. The character P is a character representing the training person 900 and expresses an action of moving up and down in accordance with the movement of the training apparatus 100 or swinging a racket in accordance with an arrival of the tennis ball B. The tennis ball B reciprocates in the left and right direction on the tennis court in accordance with the actions of the characters M and P. The game screen also includes information such as a score and elapsed time, etc. that change according to a status of the game.

As shown in FIG. 5A, at the time of starting the training attempt, the character P is positioned at an initial position $T_s$ that is the middle in the up and down direction. The character M is also positioned on the opposite side of the initial position $T_s$ with the tennis court interposed therebetween. At this time, it is desirable that the load's center of gravity CP of the training person 900 overlaps with the reference position RP as shown in FIG. 5B. That is, as a preparation for starting a training attempt, the training person 900 stands with a natural as possible standing posture in such a way that the midpoint between the training person 900's feet is positioned at the reference position RP defined for the boarding surface of the boarding plate 130.

Figure 6A:
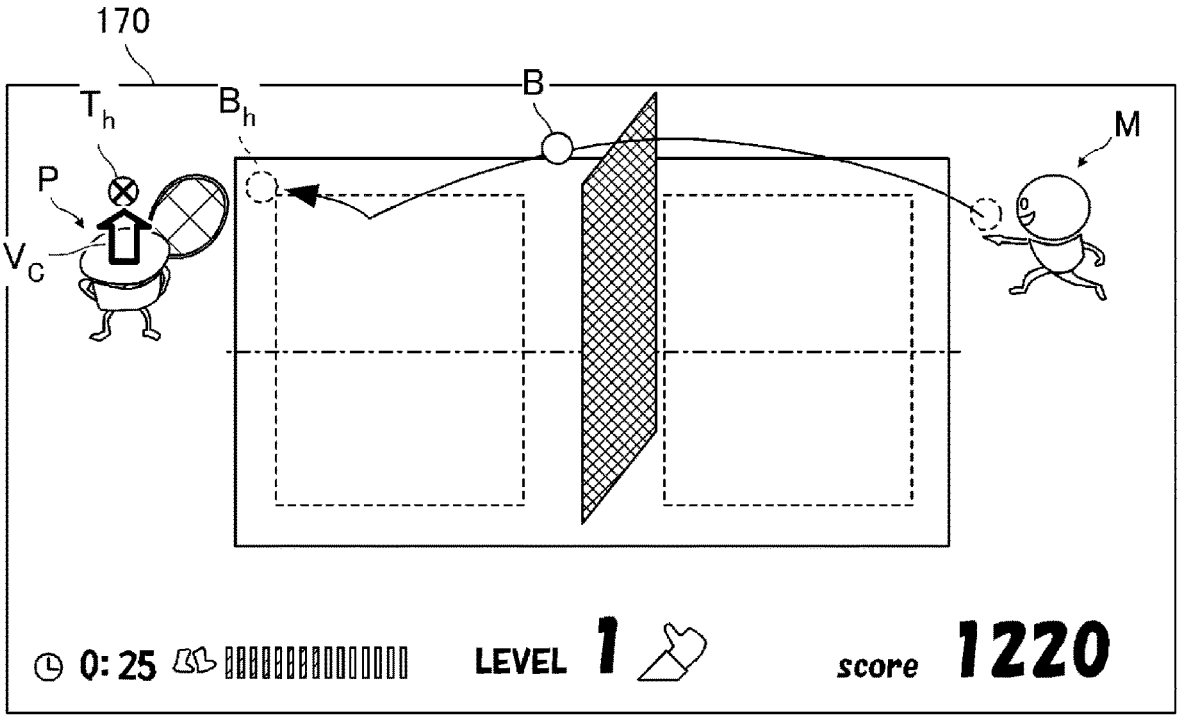
FIG. 6A shows a game screen during a training attempt.
Figure 6B:
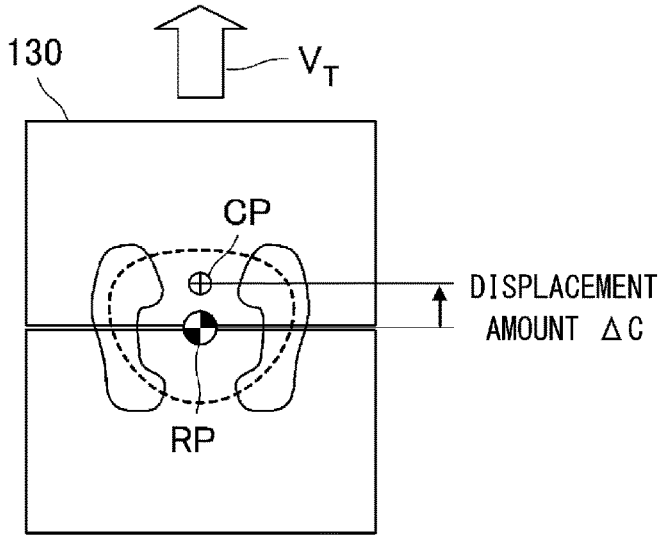
FIG. 6B shows a load's center of gravity of the training person.

FIG. 6A shows a game screen during the training attempt, and FIG. 6B show's the load's center of gravity of the training person 900 at that time. The character M moves to the upper part of the court and throws the tennis ball B so that the tennis ball B can reach a target position $B_h$ set for this task. Then, the tennis ball B moves along the locus shown in the drawing. The speed at which the tennis ball B moves is predetermined according to the level, and is faster as the level becomes higher.

The training person 900 moves the character P to a hitting position $T_h$ where he/she can hit the tennis ball B back at $B_h$ before the tennis ball B reaches $B_h$. That is, as shown in FIG. 6B, the training person 900 moves the load's center of gravity CP forward from the reference position RP by bringing the training person 900's center of gravity forward to adjust his/her balance. The movement control unit 203 moves the moving carriage 110 forward at a target speed $V_T$ set according to a displacement amount ΔC of the load's center of gravity at this time. The character P on the game screen moves to the upper part of the screen at a speed $V_c$ linked with the target speed $V_T$ of the moving carriage 110. When the character P can be moved to $T_h$ before the tennis ball B reaches $B_h$, the racket is shaken when the tennis ball B reaches $B_h$ and the tennis ball B is hit back. When the tennis ball B can be hit back, the score is incremented.

Figure 7A:
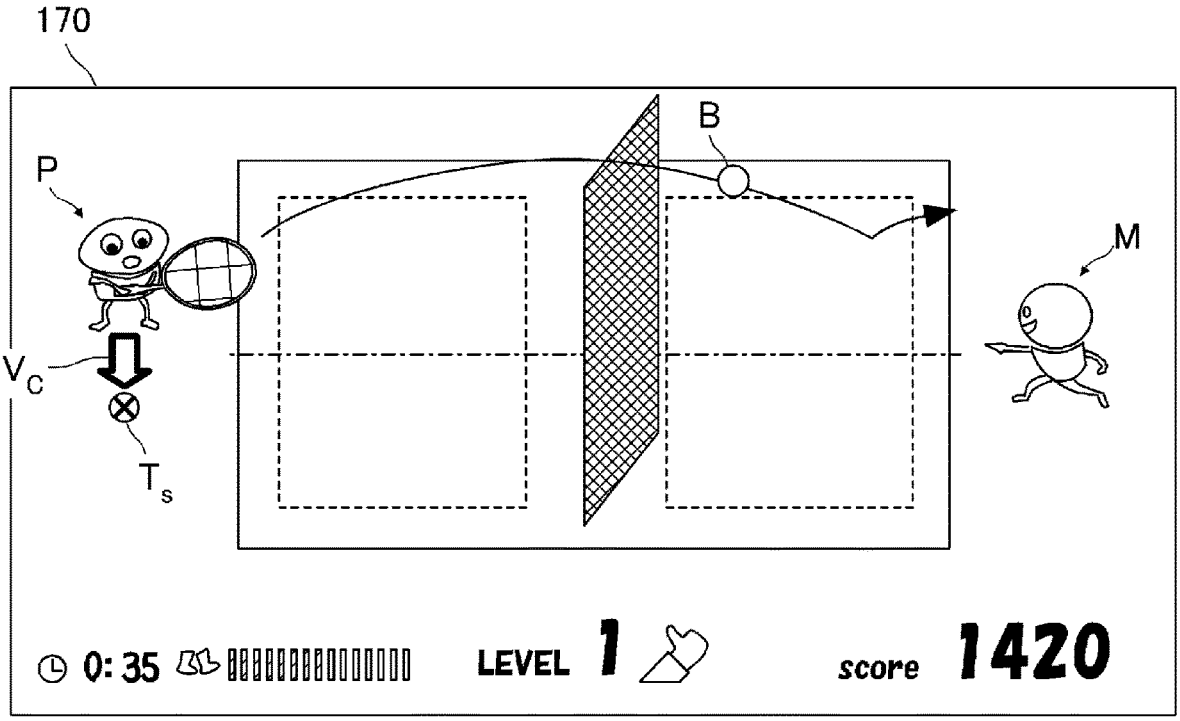
FIG. 7A shows a game screen during a training attempt.
Figure 7B:
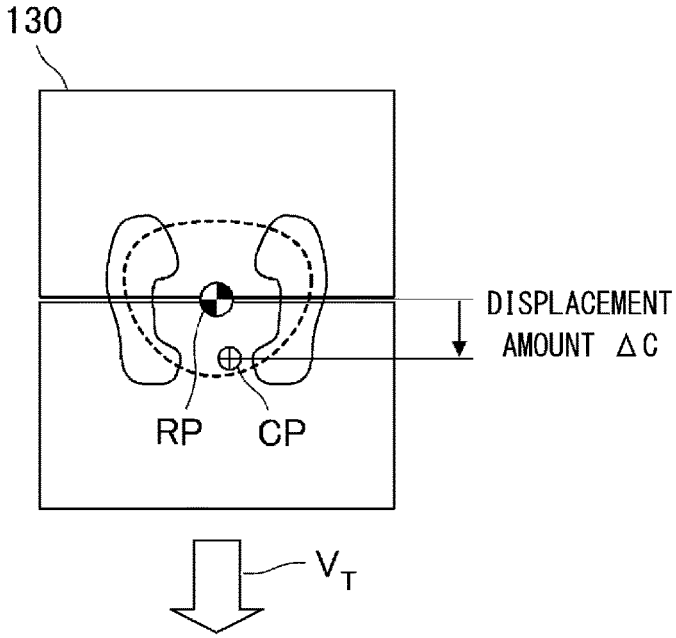
FIG. 7B shows a load's center of gravity of the training person.

FIG. 7A shows a game screen after the training attempt, and FIG. 7B shows the load's center of gravity of the training person 900 at that time. When the character P hits the tennis ball B back, the training person 900 shifts the load's center of gravity CP to behind the reference position RP by shifting the training person's center of gravity backward to adjust his/her balance. The movement control unit 203 moves the moving carriage 110 backward at the target speed $V_T$ set according to the displacement amount ΔC of the load's center of gravity at this time. The character P on the game screen moves to the lower part of the screen at the speed $V_c$ linked with the target speed $V_T$ of the moving carriage 110. When the character P can be returned to the initial position $T_s$ within a predetermined time, the score is incremented.

A certain amount of time is required until the character P reaches the hitting position $T_h$ or returns to the initial position $T_s$, although it depends on the speed $V_c$ of the character P. During this time, the training person 900 continues to adjust his/her balance by tilting his/her center of gravity. This balance adjustment is effective rehabilitation training for the training person 900 with a disease in the balance function. Further, since the load's center of gravity CP can be constantly changed according to the balance adjustment of the training person 900, the target speed $V_T$ of the moving carriage 110 and the speed $V_c$ of the character P can also change. The training person 900 not only moves the character P according to his/her balance adjustment but also moves the training apparatus 100 itself, so that the training person 900 can obtain sensations that act on his/her sense of balance and sense of posture in addition to visual information, and thus the training person 900 can enjoy the training attempt. When the training person 900 can enjoy the training attempt, it can be expected that the training person 900 can actively and continuously perform training. That is, the balance function can be recovered in a shorter period.

Figure 8:
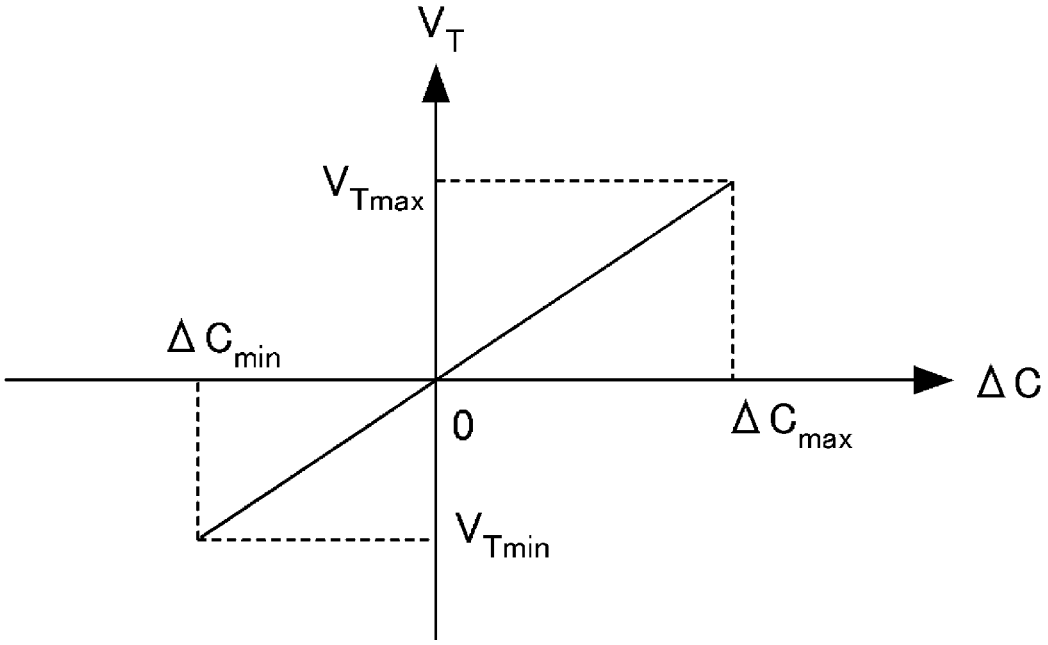
FIG. 8 shows a relationship between a displacement amount of the load's center of gravity and a target speed of a moving carriage.

FIG. 8 is a diagram showing a relationship between the displacement amount ΔC of the load's center of gravity CP and the target speed $V_T$ of the moving carriage 110. The horizontal axis represents the displacement amount ΔC. and the vertical axis represents the target speed $V_T$. When the load's center of gravity CP is within the stable range LC, the movement control unit 203 determines the target speed $V_T$ in proportion to the displacement amount ΔC as shown in the drawing. As shown in FIG. 4, the maximum value that ΔC can take when the load's center of gravity CP is within the stable range LC is $\Delta C_{max}$, and the target speed $V_T$ at that time is $V_{Tmax}$. Likewise, the minimum value that the displacement amount ΔC can take is $\Delta C_{min}$, and the target speed $V_T$ at that time is $V_{Tmin}$. When ΔC is a positive value, the moving carriage 110 moves forward, while when ΔC is a negative value, the moving carriage 110 moves backward. The proportionality coefficient may be determined in accordance with the training level. In this case, the proportionality coefficient may be increased as the training level increases.

The training person 900 who is undergoing rehabilitation training cannot necessarily adjust his/her balance during the training attempt continuously and successfully. The training person 900 may sometimes grasp the handrail 162, or changes his/her step on the boarding plate 130. In particular, since the target speed $V_T$ of the moving carriage 110 with respect to the displacement amount ΔC of the load's center of gravity CP can be appropriately set, the setting may not be appropriate for the training person 900. When the moving carriage 110 is controlled at the target speed $V_T$ that is proportional to the displacement amount ΔC without any restriction measures, when, for example, one foot is lifted from the boarding surface, there may be a sudden movement variation in the moving carriage 110 that the training person 900 does not expect. Therefore, the movement control unit 203 according to this embodiment performs safety control when the load's center of gravity CP calculated by the load calculation unit 201 falls out of the stable range LC.

Figure 9:
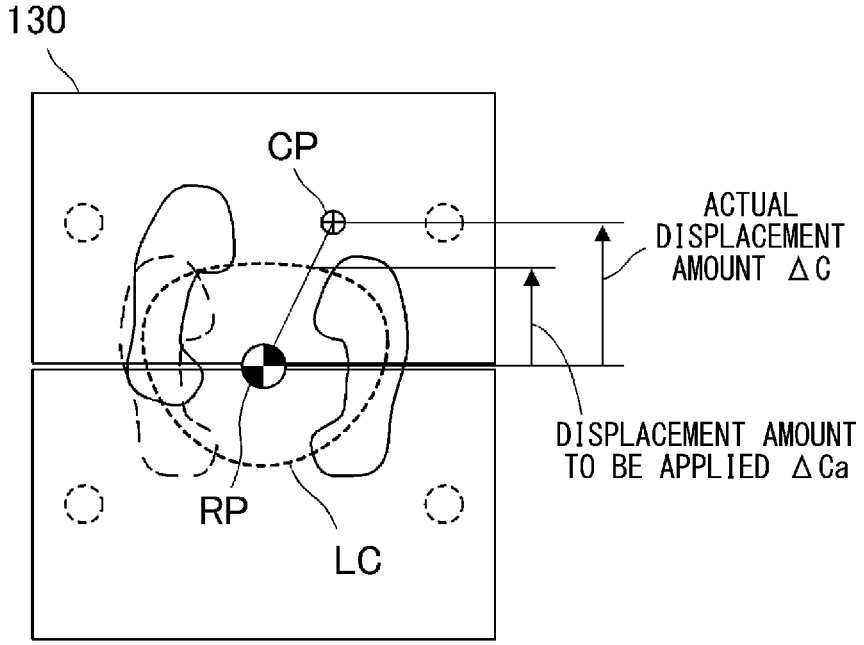
FIG. 9 shows a state in which the load's center of gravity is outside the stable range.

FIG. 9 shows a state in which the load's center of gravity CP falls out of the stable range LC. FIG. 9 shows a state in which the training person 900 cannot adjust his/her balance and steps his/her left foot forward.

The actual displacement amount along the ΔC axis with respect to the load's center of gravity CP shown in the drawing is ΔC. Further, the displacement amount with respect to a line segment connected between the reference position RP and the load's center of gravity CP intersecting with a circumference curve of the stable range LC is defined as ΔCa. The displacement amount ΔCa is employed to determine the target speed. The value of ΔCa is $\Delta C_{min}$ or more and $\Delta C_{max}$ or less, and thus the movement control unit 203 can determine the target speed $V_T$ using the relationship of FIG. 8. When the target speed $V_T$ is determined in this way, the moving speed of the moving carriage 110 does not change suddenly. Moreover, since it can be expected that the training person 900 may immediately return his/her fool which has been stepped forward while changing his/her step, the training attempt may be continued. That is, it is possible to achieve both safety ensuring for the training person 900 and smooth carrying out of training attempts.

Note that the target speed $V_T$ of the moving carriage 110 may be set to be equal to or tower than an upper limit speed. The upper limit speed here may be a speed corresponding to the displacement amount ΔCa to be applied. When the load's center of gravity CP falls outside the stable range LC, it is also assumed that the training person 900 may be upset. Thus, for example, for a certain period after the load's center of gravity CP falls outside the stable range LC, a speed obtained by multiplying the speed corresponding to the displacement amount ΔCa to be applied by a coefficient of about 0.9 may be used as the target speed $V_T$.

Figure 10:
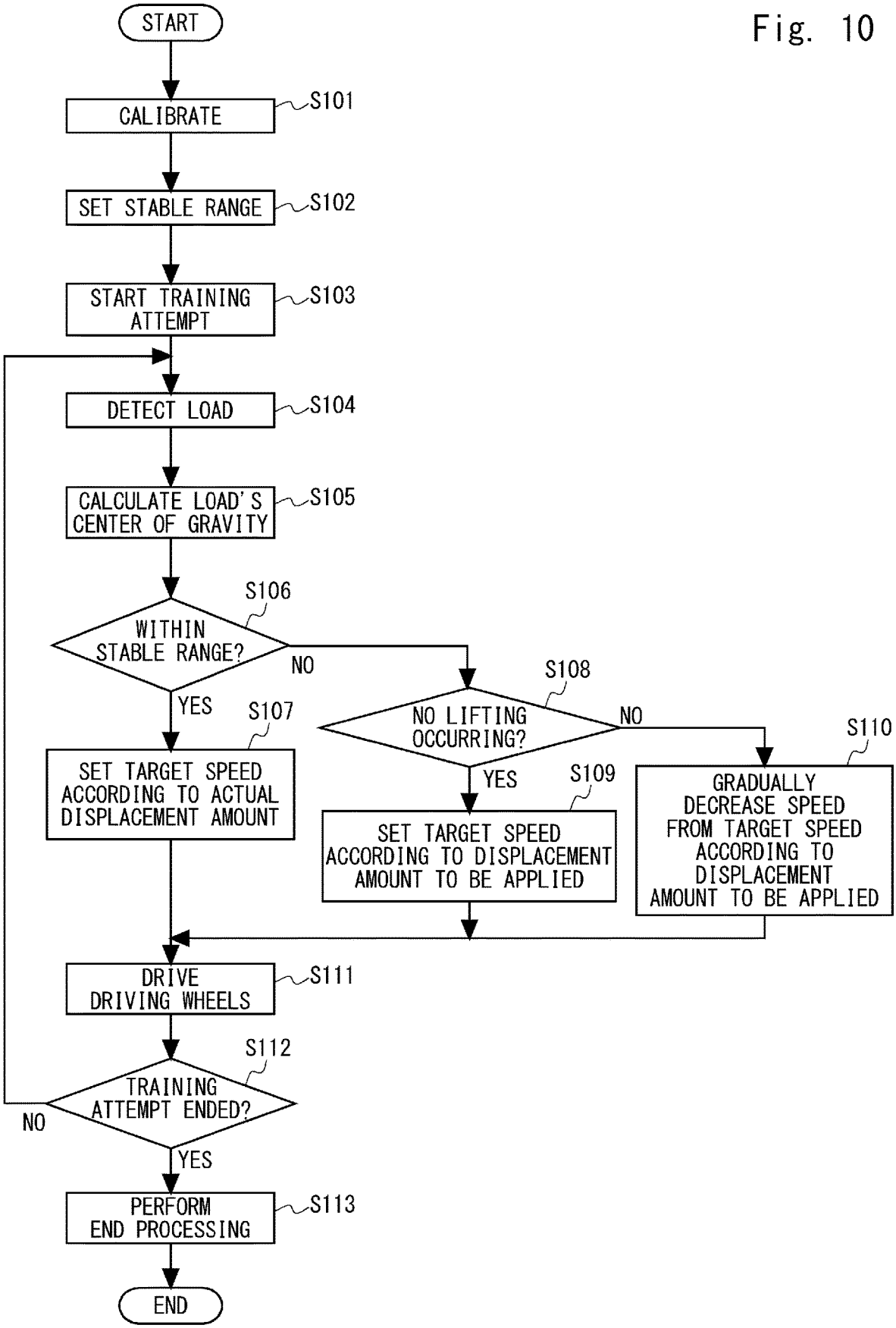
FIG. 10 shows a processing flow of a training attempt.

FIG. 10 is a flowchart showing a processing flow of a training attempt. For example, the flow is started in a state in which the training person 900 has boarded the boarding plate 130. The range setting unit 202 executes calibration in Step S101. Specifically, as described with reference to FIG. 4, the training person 900 is encouraged to perform a calibration work for sequentially shifting his/her center of gravity. For example, the display panel 170 displays "Next, shift your center of gravity to your right foot until right before your left foot is lifted". The load calculation unit 201 receives a detection signal from the load sensor 140 every time the center of gravity is shifted, and sequentially calculates the load's center of gravity $CP_F$, $CP_R$, $CP_B$, and $CP_L$. The range setting unit 202 proceeds to Step S102, and sets the stable range LC from the calculated load's center of gravity $CP_F$, $CP_R$, $CP_B$, and $CP_L$.

The arithmetic processing unit 200 proceeds to Step S103, reads the designated task game 241 from the memory 240, and starts a training attempt through the task game 241. The arithmetic processing unit 200 displays a video image in accordance with the progress of the task game 241 on the display panel 170 via the display control unit 213.

In Step S104, the load sensor 140 detects a load received from the training person 900's feet in accordance with the progress of the task game 241, and passes the detected detection signal to the load calculation unit 201. In Step S105, the load calculation unit 201 calculates the load's center of gravity from the received detection signal, and passes the calculated load's center of gravity to the movement control unit 203.

In Step S106, the movement control unit 203 determines whether the load's center of gravity received from the load calculation unit 201 is within the stable range LC set by the range setting unit 202. When the movement control unit 203 determines that the load's center of gravity is within the range, the process proceeds to Step S107, and sets the target speed of the moving carriage 110 according to the actual displacement amount ΔC corresponding to the calculated load's center of gravity. When the movement control unit 203 determines that the load's center of gravity is outside the range, the process proceeds to Step S108.

In Step S108, the movement control unit 203 determines whether at least one of the training person 900's toe and the training person 900's heel is lifted in the air. When the movement control unit 203 determines that no lifting is occurring, the process proceeds to Step S109 where the displacement amount ΔCa to be applied is calculated from the load's center of gravity calculated as described with reference to FIG. 9 and sets the target speed of the moving carriage 110 according to the calculated displacement amount ΔCa. When the movement control unit 203 determines that the lifting is occurring, the process proceeds to Step S110 where the displacement amount ΔCa to be applied is calculated from the calculated load's center of gravity as described with reference to FIG. 9, and transitions to deceleration control for gradually decreasing the target speed as the lime elapses. When the target speed is set in Steps S107, S109, and S110, the process proceeds to Step S111.

In Step S111, the movement control unit 203 calculates a driving torque corresponding to the set target speed, and transmits a driving signal for outputting the driving torque to the driving wheel unit 210. The movement control unit 203 sequentially acquires the rotational speed of the driving wheels 121 from the driving wheel unit 210 and performs feedback control so that the difference between the rotational speed and the target speed becomes zero.

When the deceleration control is performed, the target speed is temporarily set to zero over a certain period of time from the target speed $V_T$ at the time when an occurrence of the lifting is determined. The certain period of time in this case may be determined according to the magnitude of the target speed $V_T$ and the progress of the rehabilitation training of the training person 900. When such safety control is performed, the training attempt can be safely interrupted, and the training person 900 can be calmed down. The movement control unit 203 may resume the training attempt when a resume instruction is received from the training person 900 or when a certain period of time has elapsed.

In Step S110, the arithmetic processing unit 200 determines whether the training attempt has ended. The training attempt ends, for example, when the task game 241 ends, a set period of time elapses, or a target item is achieved. When the arithmetic processing unit 200 determines that the training attempt has not ended, the process returns to Step S104 where the training attempt is continued, whereas when the arithmetic processing unit 200 determines that the training attempt has ended, the process proceeds to Step S111. In Step S111, the arithmetic processing unit 200 executes end processing to end a series of processing. The end processing is to display the final score on the display panel 170 and update history information of the training that has been carried out so far.

When it is determined that the lifting is occurring, the movement control unit 203 may transition to limit speed control instead of the deceleration control. In the limit speed control, as described above, the speed corresponding to the displacement amount ΔCa to be applied is set as an upper limit speed. For example, a speed obtained by multiplying a coefficient of about 0.9 by the speed corresponding to the displacement amount ΔCa to be applied is set as a target speed $V_T$ for a certain period after an occurrence of the lifting is determined. In any case, when the lifting is detected, the speed control which puts emphasis on safety may be performed.

Figure 11:
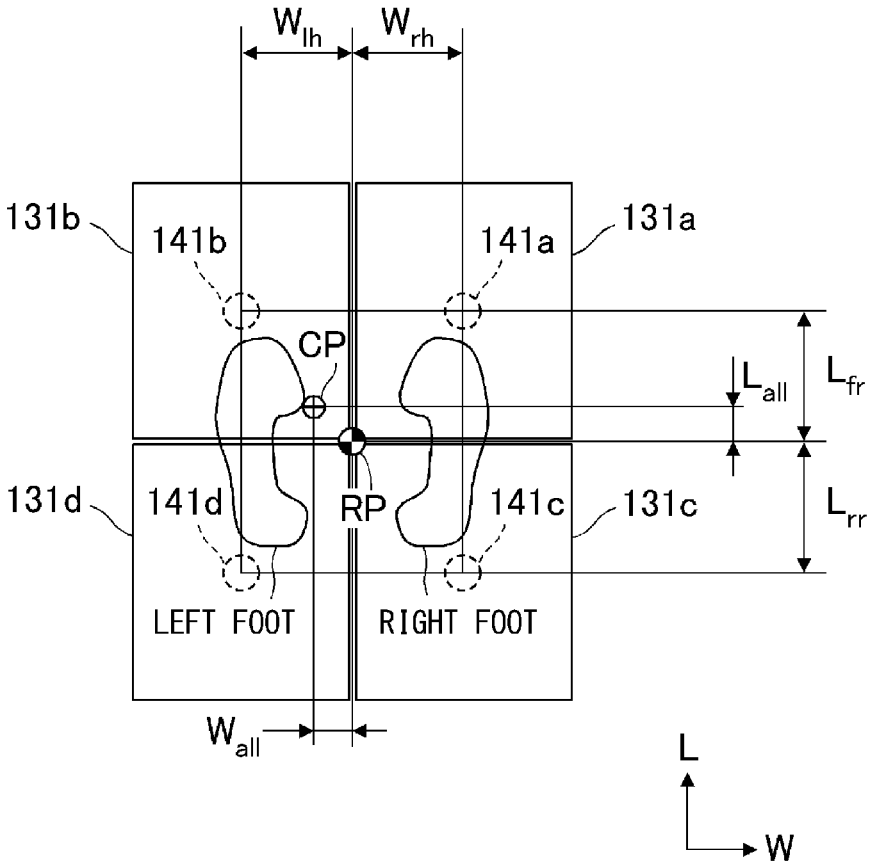
FIG. 11 is a diagram for explaining a state of a boarding plate and calculation of a load's center of gravity according to another embodiment.

In this embodiment described above, an example in which the boarding plate 130 is divided into the front plate 130*a* and the rear plate 130*b* has been described. An example of the division of the boarding plate 130 is not limited to this. FIG. 11 is a diagram for explaining the state of the boarding plate 131 and the calculation of the load's center of gravity according to another embodiment. As shown in the drawing, the boarding plate 130 is divided into a right front plate 131*a*, a left front plate 131*b*, a right rear plate 131*c*, and a left rear plate 131*d*. The right front plate 131*a* is supported by a right front load sensor 141*a* provided on a rear surface side opposite to a boarding surface. Likewise, the left front plate 131*b* is supported by a left front load sensor 141*b*, the right rear plate 131*c* is supported by a right rear load sensor 141*c*, and the left rear plate 131*d* is supported by a left rear load sensor 141*d*.

As in the example of FIG. 3, the reference position RP, the W axis, and the L axis are defined, and the positions where the right front load sensor 140*a*, the left front load sensor 140*b*, the right rear load sensor 140*c*, and the left rear load sensor 140*d* are installed are defined as $(W_{rh}, L_{rr})$, $(W_{lh}, L_{fr})$, $(W_{rh}, L_{rr})$, and $(W_{lh}, L_{rr})$, respectively. A coordinate value $(W_{all}, L_{all})$ of the entire load's center of gravity CP is expressed by the Formulas 5 and 6.

$$W_{all}=((f_a+f_c)\times W_{rh}+(f_b+f_d)\times W_{lh})/(f_a+f_b+f_c+f_d) \quad \text{(Formula 5)}$$

$$L_{all}=((f_a+f_b)\times L_{fr}+(f_c+f_d)\times L_{rr})/(f_a+f_b+f_c+f_d) \quad \text{(Formula 6)}$$

In the Formulas 5 and 6, $f_a$ is a load detected by the right front load sensor 140*a*, and $f_b$ is a load detected by the left front load sensor 140*b*.

The same movement control as that according to the above-described embodiments can also be performed with the load's center of gravity CP calculated in this manner. In addition, when the boarding plate 130 is divided into the left and right boarding plates in addition to being divided into the front and rear boarding plates in this way, it is possible to more accurately distinguish between the lifting of the right foot and the lifting of the left foot. Further, when the boarding plate is divided in this way, the training person 900 can board in a direction orthogonal to the moving direction of the moving carriage 110. Thus, the single training apparatus 100 can also be used safely for balance training in the right-left direction.

In each of the embodiments described above, a case in which the minimum number of load sensors is arranged has been described, but the number of load sensors may be further increased. The increased number of load sensors can improve the stability of the boarding plate 130, and improve the accuracy of the load's center of gravity.

In the above-described embodiments, the moving carriage 110 has a structure that moves back and forth, and thus the movement control and task games corresponding to such a structure are employed. However, when the moving carriage 110 has a structure that also moves in the right-left direction, the movement control and task games corresponding to such a structure that moves back and forth and also left and right may be employed. In the above-described embodiments, the speed control is performed by calculating the displacement amount ΔC in the front-rear direction, which is the moving direction of the moving carriage 110, with respect to the two-dimensionally defined stable range LC. However, when the moving carriage 110 can also move in the right-left direction, the moving direction and the target speed may be determined according to a vector from the reference position RP to the load's center of gravity.

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A balance training system comprising:

a moving carriage configured to be able to move on a moving surface by driving a driving unit;

a detection unit configured to detect a load received from training person's feet standing on the moving carriage;

a calculation unit configured to calculate a load's center of gravity of the training person's feet on a boarding surface from the load detected by the detection unit; and a control unit configured to drive the driving unit based on the load's center of gravity calculated by the calculation unit to control movement of the moving carriage, wherein a boarding plate constituting the boarding surface is divided into a front plate and a rear plate, a toe side of the training person's feet is being placed on the front plate, and a heel side of the training person's feet is being placed on the rear plate, and the detection unit comprises a right front load sensor provided with a tilt to a right foot side and a left front load sensor provided with a tilt to a left foot side on a rear surface side opposite to the boarding surface of the front plate and a right rear load sensor provided with a tilt to the right foot side and a left rear load sensor provided with a tilt to the left foot side on a rear surface side opposite to the boarding surface of the rear plate.

2. The balance training system according to claim 1, wherein the front plate is divided into a right front plate corresponding to a position where the right front load sensor is provided and a left front plate corresponding to a position where the left front load sensor is provided, and the rear plate is divided into a right rear plate corresponding to a position where the right rear load sensor is provided and a left rear plate corresponding to a position where the left rear load sensor is provided.

3. The balance training system according to claim 1, wherein the control unit is configured to determine whether the training person's toe and heel are lifted in the air based on the load's center of gravity calculated by the calculation unit, and control the movement of the moving carriage based on a result of the determination.

4. The balance training system according to claim 3, wherein when the control unit determines that one of the training person's toes and the training person's heels are lifted in the air, the control unit is configured to perform deceleration control for gradually decreasing a moving speed of the moving carriage.

5. The balance training system according to claim 3, wherein when the control unit determines that one of the training person's toes and the training person's heels are lifted in the air, the control unit is configured to perform limit speed control for limiting a moving speed of the moving carriage to less than or equal to a predetermined limit speed.

6. A balance training system comprising:

a moving carriage configured to be able to move on a moving surface by driving a driving unit;

a sensor configured to detect a load received from training person's feet standing on the moving carriage; and a processor, wherein the processor is configured to calculate a load's center of gravity of the training person's feet on a boarding surface from the load detected by the sensor, the processor is configured to drive the driving unit based on the calculated load's center of gravity to control movement of the moving carriage, a boarding plate constituting the boarding surface is divided into a front plate and a rear plate, a toe side of the training person's feet is being placed on the front plate, and a heel side of the training person's feet is being placed on the rear plate, and the sensor comprises a right front load sensor provided with a tilt to a right foot side and a left front load sensor provided with a tilt to a left foot side on a rear surface side opposite to the boarding surface of the front plate and a right rear load sensor provided with a tilt to the right foot side and a left rear load sensor provided with a tilt to the left foot side on a rear surface side opposite to the boarding surface of the rear plate.

7. A control method for a balance training system comprising a moving carriage configured to be able to move on a moving surface by driving a driving unit, the control method comprising:

detecting a load received from training person's feet standing on the moving carriage;

calculating a load's center of gravity of the training person's feet on a boarding surface from the load detected by the detecting; and controlling the driving unit based on the load's center of gravity calculated by the calculating to control movement of the moving carriage, wherein a boarding plate constituting the boarding surface is divided into a front plate and a rear plate, a toe side of the training person's feet is being placed on the front plate, and a heel side of the training person's feet is being placed on the rear plate, and the detecting is executed by a right front load sensor provided with a tilt to a right foot side and a left front load sensor provided with a tilt to a left foot side on a rear surface side opposite to the boarding surface of the front plate and a right rear load sensor provided with a tilt to the right foot side and a left rear load sensor provided with a tilt to the left foot side on a rear surface side opposite to the boarding surface of the rear plate.

* * * * *